United States Patent [19]

Mattox

[11] Patent Number: 4,641,832

[45] Date of Patent: Feb. 10, 1987

[54] WRIST/ANKLE EXERCISING APPARATUS

[75] Inventor: Ernest M. Mattox, Belmont, Mich.

[73] Assignee: Portable Isokinetics, Inc., Grand Rapids, Mich.

[21] Appl. No.: 603,409

[22] Filed: Apr. 24, 1984

[51] Int. Cl.[4] ..... A63B 5/00

[52] U.S. Cl. ..... 272/67; 272/131

[58] Field of Search ..... 272/67, 93, 116, 125, 272/126, 130, 131, 132, 133, 142, DIG. 5; 125/25 R

[56] References Cited

U.S. PATENT DOCUMENTS

| | | | |
|---|---|---|---|
| 906,538 | 12/1908 | Limgoes | 272/67 X |
| 2,621,043 | 12/1952 | Olmstead . | |
| 2,680,967 | 6/1954 | Newman . | |
| 2,708,367 | 5/1955 | Lusk . | |
| 2,819,081 | 1/1958 | Touraine | 272/132 X |
| 2,832,334 | 4/1958 | Whitelaw . | |
| 2,921,791 | 1/1960 | Berne | 272/132 |
| 3,174,343 | 4/1965 | Kasulis . | |
| 3,298,688 | 1/1967 | Grzybowski . | |
| 3,466,931 | 9/1969 | Spackman, Jr. et al. . | |
| 3,495,824 | 2/1960 | Cuinier | 272/130 |
| 3,563,542 | 2/1971 | Wellman | 272/67 X |
| 3,971,255 | 7/1976 | Varney et al. . | |
| 4,249,725 | 2/1981 | Mattox . | |
| 4,258,913 | 3/1981 | Brentham | 272/130 X |
| 4,471,957 | 9/1984 | Engalitcheff, Jr. | 272/132 |
| 4,487,199 | 12/1984 | Saringer | 128/25 R |

FOREIGN PATENT DOCUMENTS

| | | | |
|---|---|---|---|
| 1254913 | 1/1961 | France | 128/25 R |
| 604340 | 5/1960 | Italy | 272/142 |
| 2031288 | 4/1980 | United Kingdom . | |

*Primary Examiner*—Richard J. Apley
*Assistant Examiner*—Robert W. Bahr
*Attorney, Agent, or Firm*—Varnum, Riddering, Schmidt & Howlett

[57] ABSTRACT

A wrist/ankle exercising apparatus (100) is adapted for use by a patient (254) to exercise selected muscle/skeletal groups in the wrist, lower leg and ankle regions. The apparatus (100) includes a portable structural frame (102) having an adjustably mounted saddle assembly (108). An elongated outer tube (138) is coupled to the frame (102) and a power slide (142) is friction mounted on the tube (138). Actuating members (120, 226, 234, 242) selectively connectable to the apparatus (100) are coupled through a cable (232) to the power slide (142). Rotation of the actuating members (120, 226, 234, 242) results in axial movement of the power slide (142 ) on the outer tube (138) and linear movement of the outer tube (138) with respect to a stationary rod (190) axially coupled to the outer tube (138) and rigidly mounted to the structural frame (102). A force measuring mechanism (140) is mounted to the tube (138) so as to measure external forces exerted by the user in moving the tube (138) relative to the stationary rod (190).

13 Claims, 13 Drawing Figures

FIG. 7
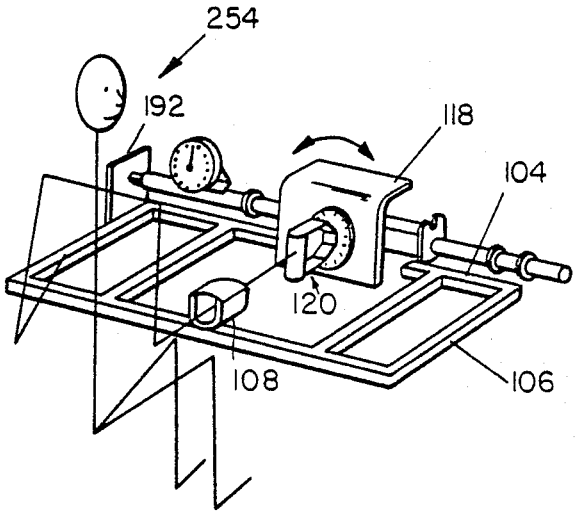
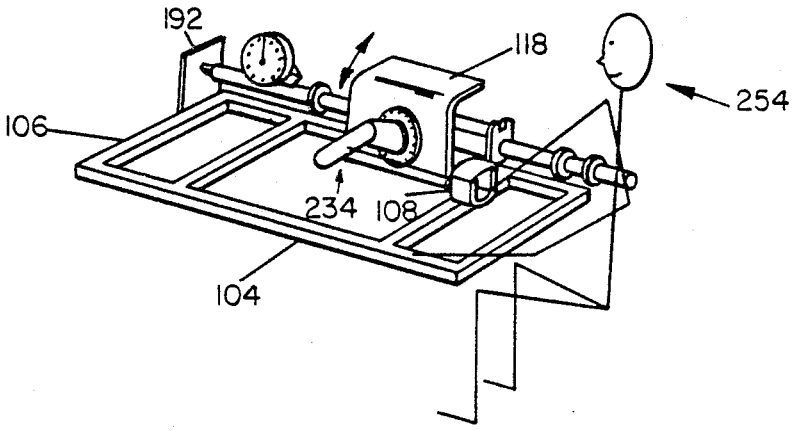
FIG. 8

WRIST/ANKLE EXERCISING APPARATUS

DESCRIPTION

1. Technical Field

The invention relates to exercise apparatus and, more particularly, to portable apparatus for exercising selected muscle/skeletal groups in the wrist and ankle regions, and for measuring the relative magnitudes of forces exerted during exercise.

2. Background Art

Various types of exercise equipment have been developed throughout history. This equipment is often directed to the exercising and strengthening of various muscle groups, such as the commonly known hand-held squeezing devices for exercising muscles of the hands and lower arm. However, more complex devices have been designed for use in strengthening and exercising other selected muscle groups. Historically, many of these devices used weights, springs or other preset resistances to movement. Such devices required the user to use only that amount of strength necessary to move the device through a weakest part of any movement.

Recently, other devices have been developed which offer resistance at a level adapting automatically to the user's abilities and providing resistance at a level the same or nearly the same as the force applied throughout the entire range of an exercise stroke. Such equipment is typically referred to as "isokinetic" exercising equipment. Many isokinetic exercise devices are relatively complex, expensive and require frequent maintenance. In addition, many of these devices are relatively large and typically require positioning at a stationary fixed location.

Examples of isokinetic exercising equipment are disclosed in the U.S. Pat. Nos. to Mattox, 4,249,725 issued Feb. 10, 1981, and 4,385,760 issued May 31, 1983. More recently, a new isokinetic exercise device has the form of a cane which is relatively portable and capable of movement from location to location. This device is particularly advantageous for handicapped individuals.

Although the cane provides substantial advantages over other known exercising equipment, the number and variety of different exercises that can be performed for muscle/skeletal groups in a particular body region is somewhat limited. For example, the variety of exercises available for muscle/skeletal group in the wrist region is somewhat limited when the apparatus does not provide any supporting structure for the user's arm region so as to gain leverage. In addition, for exercises associated with the muscle/skeletal groups in the ankle region, the scope is somewhat limited when the apparatus does not include any devices for securing the user's ankle or lower leg.

One type of known exercise apparatus at least partially overcoming these disadvantages and specifically directed to exercises for shoulder and wrist muscle/skeletal groups employs a bell crank coupled to a sleeve-like slide. The slide is friction-mounted to a horizontal stationary tube connected to opposing ends of a supporting structure. Rotation of the bell crank by the user is opposed by the resistance to movement of the slide in an axial direction with respect to the tube.

It is also advantageous for exercising equipment to employ mechanisms for measuring forces exerted by the user during exercise. For example, in the U.S. Pat. No. to Varney et al, 3,971,255 issued July 27, 1976, an exercise bar includes a sleeve mounted to an elongated tube and slidable with respect to the tube. Bushings within the tube provide a friction slide between the sleeve and the tube, and handles are provided on the sleeve and at one end of the tub. Resistance of the sleeve on the tube is provided through a flat-headed pin and adjustably tensioned spring which exerts forces on the pin. A force measuring device is provided by a coil spring which is positioned between the outer end of the sleeve and an internal bushing. A gauge is mounted on the sleeve and indicates the amount of force applied by the user.

SUMMARY OF THE INVENTION

In accordance with the invention, a wrist/ankle exercise apparatus includes a portable structural frame to provide a fixed base support while the apparatus is in use. An elongated tube is mounted to the frame, and a slide member is slidably mounted on the tube with means providing frictional resistance to movement of the slide member along the tube. A slide actuating member is rotatably mounted to the frame and coupled to the slide member so as to translate rotational movement of the slide-actuating member to linear motion of the slide member on the tube. Force measuring means are mounted on the tube to visually indicate the relative magnitude of force applied between the slide member and the tube. The user may move the slide member along the elongated tube by rotation of the slide-actuating member.

The wrist/ankle exercise apparatus also include pedal means mounted to the slide-actuating member. The pedal means are operable by the user through rotation of the user's ankle. In addition, crank means are releasably mounted to the slide-actuating member so that the user can move the slide member along the tube by rotation of his or her wrist. Handle means are also provided and releasably secured to the slide-actuating member so that the user can move the slide member along the tube by axial rotation of his or her arm.

The exercise apparatus can also include body-engaging means mounted to the structural frame. The body-engaging means are adapted to receive one of the user's legs or arms so as to restrain movement of the leg or arm during rotation of the slide actuating member. In one form of the invention, the body-engaging means includes a U-shaped saddle mounted to the slide member. Means are mounted to the saddle for releasably retaining the leg or arm within the saddle.

The elongated tube includes a first end mounted to the structural frame. The force measuring means are positioned on the tube adjacent the first end of the tube.

BRIEF DESCRIPTION OF THE DRAWINGS

FIG. 7 depicts use of the wrist/ankle exercising apparatus shown in FIG. 1 for forearm rotation;

FIG. 8 depicts use of the wrist/ankle exercising apparatus shown in FIG. 1 for wrist flexion and extension with employment of the alternative handle assembly shown in FIG. 6B;

DETAILED DESCRIPTION

The principles of the invention are disclosed, by way of example, in a wrist/ankle exercise apparatus 100 as depicted in FIGS. 1–5. The exercise apparatus 100 is adapted for use by individuals as a stand-alone unit to exercise various muscles in the wrist, forearm, ankle and lower leg regions. The apparatus 100 is relatively simple in design, lightweight and portable, thereby particularly advantageous for use by handicapped individuals or other patients undergoing rehabilitative exercise therapy. As will be described in detail herein, the apparatus 100 is adapted to provide resistance to movement during an exercise stroke, thereby requiring strengthening forces to be exerted by the patient. In addition, the apparatus 100 includes means for measuring the forces exerted by the user patient during exercise.

Figures 1, 6A, 6B, 6C:
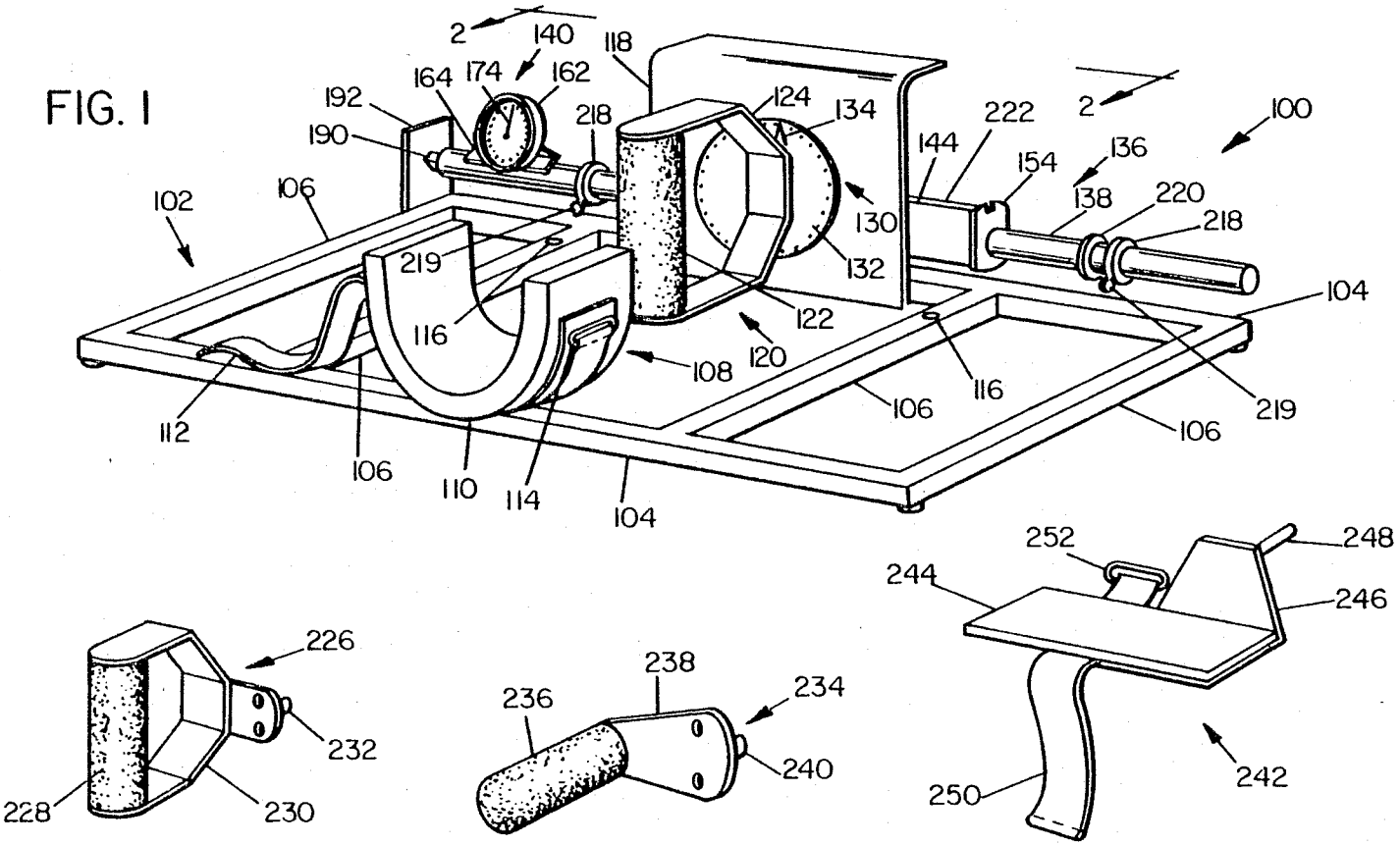
FIG. 1 is a perspective view of a wrist/ankle exercising apparatus in accordance with the invention.
FIG. 6A depicts a handle assembly alternatively employed with the wrist/ankle exercising apparatus shown in FIG. 1.
FIG. 6B depicts an additional handle assembly alternatively employed with the wrist/ankle exercising apparatus shown in FIG. 1.
FIG. 6C depicts a foot pedal assembly alternatively employed with the wrist/ankle exercising apparatus shown in FIG. 1.

Referring specifically to FIG. 1, the wrist/ankle exercise apparatus 100 comprises a rectangularly-shaped and portable frame 102 having front and rear members 104 interconnected by perpendicular cross-members 106. Mounted to the frame 102 is a saddle assembly 108 adapted to provide leverage for the user during exercise. The saddle assembly 108 includes a U-shaped saddle 110 releasably mounted to the frame 102. The saddle assembly 108 also includes a flexible strap 112 attached to the outer surface of the U-shaped saddle 110. A buckle 114 is provided for purposes of securing the patient's arm or leg within the U-shaped saddle 110 as subsequently described herein. For purposes of mounting the saddle assembly 108 to the frame 102, a short stem (not shown) or similar securing means can be mounted to the outer surface of the bight portion of the U-shaped saddle 110 and received in means such as the socket 116 located on one of the cross-members 106. The saddle assembly 108 can be mounted to other portions of the frame 102, such as the mounting arrangement shown on FIG. 1 whereby the U-shaped saddle 110 is releasably secured to the front member 104 of frame 102.

Figure 2:
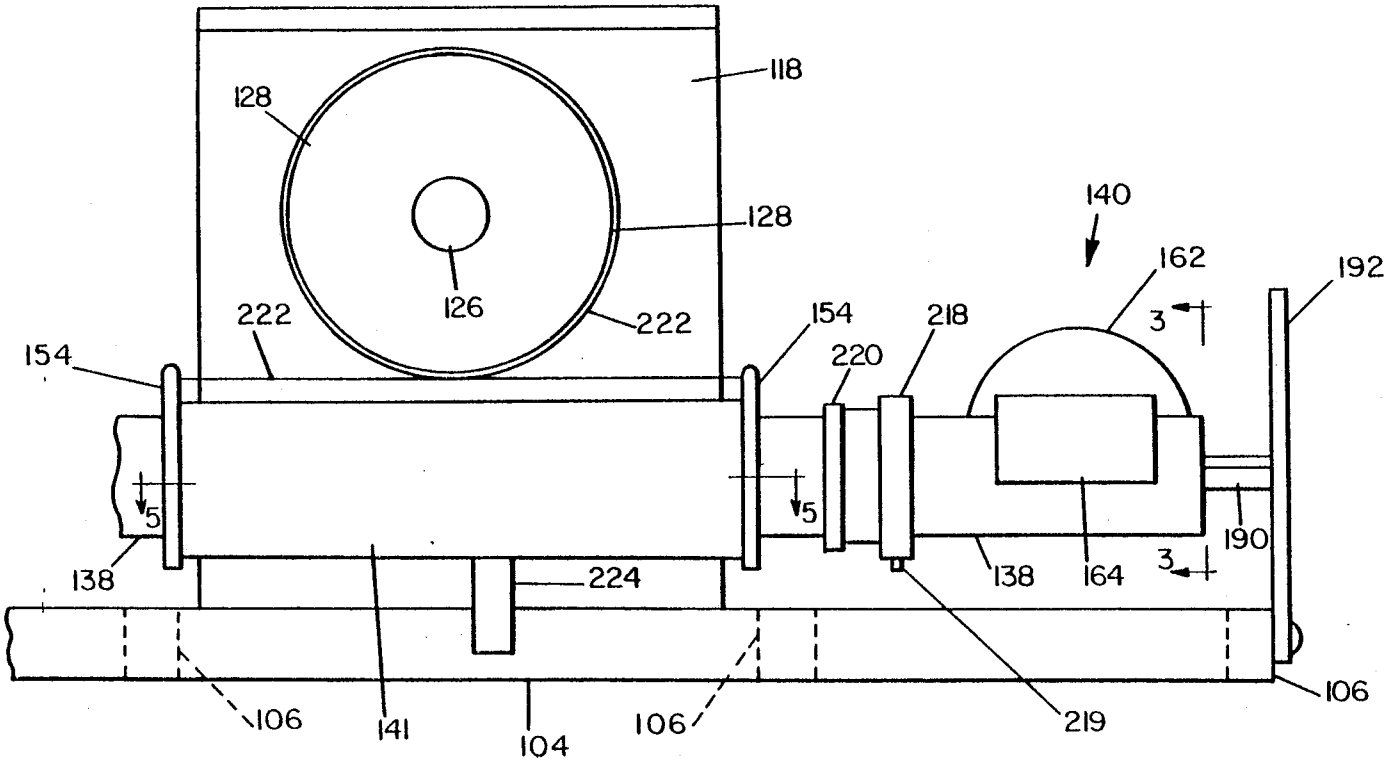
FIG. 2 is a rear view of a portion of the wrist/ankle exercising apparatus taken along lines 2—2 of FIG. 1.

Rigidly mounted to the rear member 104 is a vertically disposed plate 118 having a handle assembly 120 releasably secured thereto. The handle assembly 120 includes a handgrip 122 and a bracket 124 rotatably secured to the plate 118. Referring to FIG. 2, the handle assembly 120 includes a rotating axle 126 extending through the plate 118 and secured to a pulley wheel 128. The interconnection between the plate 118, handle assembly 120 and pulley wheel 128 can be through any of several conventional structures so that rotation of handle assembly 120 relative to the plate 118 results in corresponding rotation of pulley wheel 128.

A goniometer 130 comprising a dial face 132 and a pointer 134 are provided on the vertically disposed plate 118 to indicate to the user patient the extent of rotation of the handle assembly 120 with respect to the plate 118. The dial face 132 is rigidly mounted to the plate 118, and the pointer 134 is mounted to the rotating axle 126 so as to move in correspondence therewith.

Referring to FIGS. 1 and 2, the wrist/ankle exercise apparatus 100 also includes an exercise bar assembly 136. As specifically shown in FIG. 2, the exercise bar assembly 136 includes an elongated outer tube 138 having a force measurement mechanism 140 mounted to one end of the tube 138. The force measurement mechanism 140 provides a means for visually indicating to the user patient the amount of force being exerted during exercises as subsequently described herein.

As also shown in FIG. 2, mounted to the elongated outer tube 138 near the center portion thereof is a power slide 142 comprising a slidable sleeve 144. The power slide 142 is received on the elongated outer tube 138 and friction mounted thereto. That is, the sleeve 144 is slidable along the outer tube 138, but with some degree of force required to generate the sliding movement. The friction mounting can also provide, if desired, a substantially higher frictional resistance to movement of the sleeve 144 in one direction along the axial length of tube 138 then in the opposing direction of relative movement. Ordinarily, a friction mounting arrangement works in an isotropic manner. In addition, the friction mounting can provide for a frictional resistance directly proportional to the linear forces exerted by the user patient and applied to the sleeve 144 relative to the outer tube 138.

Figure 5:
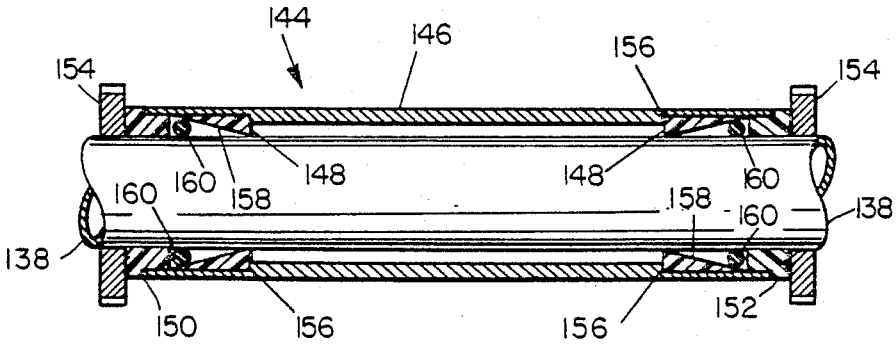
FIG. 5 is sectional view of the exercise bar mechanism of the wrist/ankle exercising apparatus showing an exemplary friction mounting of the power slide to the elongated tube and taken along lines 5—5 of FIG. 2.

An exemplary friction mounting arrangement comprising several of these features and suitable for use in the wrist/ankle exercising apparatus 100 is depicted in FIG. 5. Referring thereto, the sleeve 144 comprises a tubular member 146 which is concentric with the axis of the outer tube 138. The inner diameter of the tubular member 146 is larger than the outer diameter of the tube 138 so that an annular space is provided therebetween. Annular shoulders 148 are found in the inner surface of the tubular member 146. The tubular member 146 is supported on the elongated tube 138 by a pair of annular frictionless bushings 150 and 152. The bushings 150 and 152 are maintained on the tubular member 146 through any suitable connecting means, such as a pair of set screws, staking, or adhesive interconnections. At each end of the sleeve 144 are also mounted one of a pair of cable support brackets 154 having a cable support function as subsequently described herein. The support brackets 154 are mounted to the sleeve 144 so as to move in correspondence with the tubular member 146 relative to the elongated outer tube 138.

A pair of brake mechanisms 156 are mounted within the tubular member 146, adjacent to the frictionless bushing 150 and 152 and in abutting relationship with the corresponding annular shoulders 148. The brake mechanisms 156 each comprise an elongated annular bushing, preferably made of plastic and having an internal ramped or conical surface 158. A pair of rubber O-rings 160 are slidably mounted to the elongated tube 138, each fitting within an end of a corresponding annular brake mechanism 156. The inner diameter of each O-ring 160 is only slightly smaller than the outer diameter of the outer tube 138 so that there is some frictional resistance between each O-ring 160 and the outer tube 138. Any suitable rubber or synthetic rubbery material can be used.

In operation, as the sleeve 144 moves to the right as viewed in FIG. 5, relative to the elongated outer tube 138, the frictional resistance between the O-ring 160 on the right and the elongated tube 138 causes the right-side O-ring 160 to ride up on the corresponding and adjacent ramp 158, thereby increasing the frictional resistance between the right-side O-ring 160 and the outer tube 138. The extent of movement of the O-ring 160 and the extent of frictional forces applied between the O-ring 160 and the outer tube 138 depend on the forces applied to the power slide 142. In other words, the harder the force, the greater the frictional resistance of the sleeve 144. Thus, the power slide 142 provides a varying kinematic resistance to movement along the outer tube 138, the amount of frictional resistance being dependent upon the amount of force applied to the power slide 142 with respect to the outer tube 138.

During movement of sleeve 144 to the right as viewed in FIG. 5, the left-side O-ring 160 will move into an abutting relationship with the corresponding bushing 150. In this position of the left-side O-ring 160 with respect to the surface 158 of corresponding brake mechanism 156, little or no frictional resistance is applied by the left-side O-ring 160 on the elongated tube 138. However, movement of the sleeve 144 to the left as viewed in FIG. 5 will cause the left-side O-ring 160 to ride up on ramp surface 158 of the corresponding left-side brake mechanism 156. In the same manner as previously described for movement of sleeve 144 to the right, the amount of frictional resistance between sleeve 144 and tube 138 will be dependent upon the amount of force applied to power slide 142 with respect to the outer tube 138.

It should be emphasized that various other types of friction mounting arrangements can be employed with the power slide 142 and the elongated outer tube 138 of wrist/ankle exercise apparatus 100. The aforedescribed particular means for mounting the power slide 142 to the elongated outer tube 138 does not form the basis for the principal concepts of the invention described and claimed herein.

Figure 3:
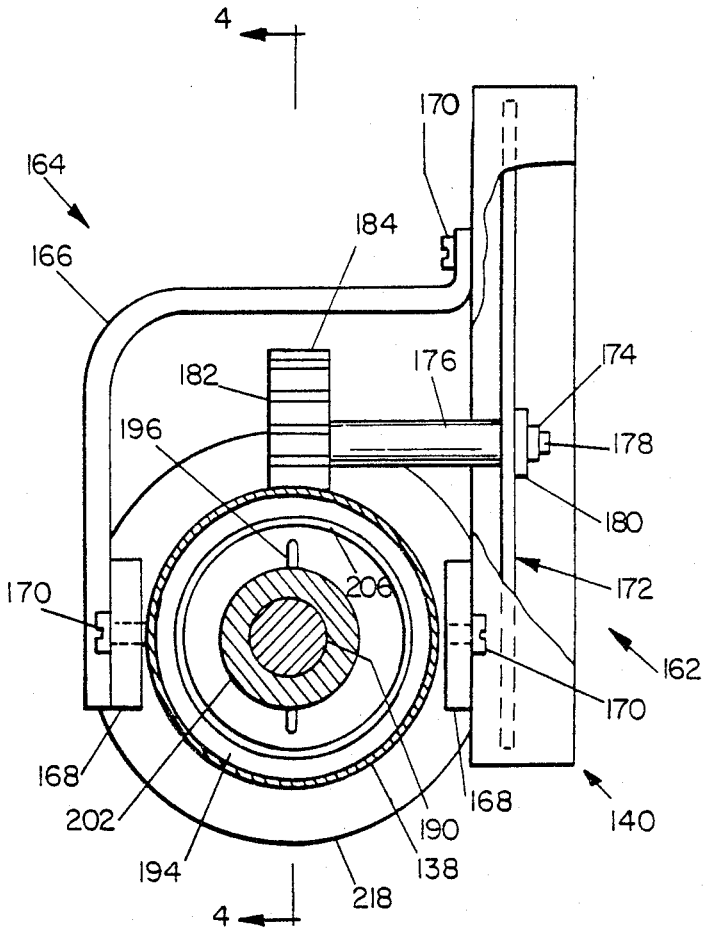
FIG. 3 is a sectional view of the wrist/ankle exercising apparatus showing components of the force measuring mechanism and taken along lines 3—3 of FIG. 2.

As previously referenced, a force measurement mechanism 140 is mounted to one end of the elongated outer tube 138 as shown in FIG. 1. Referring to FIGS. 1 and 2, and particularly to FIGS. 3 and 4, the force measurement mechanism 140 includes a circular gauge housing 162 rigidly mounted to the outer tube 138 by means of a gauge bracket mounting 164. Referring particularly to FIG. 3, the bracket mounting 164 includes an angled bracket 166 secured to the rear portion of the gauge housing 162 and one of two straight brackets 168 through screws 170. At the rear portion of the elongated tube 138 as depicted in FIG. 3, the gauge housing 162 is directly mounted to the elongated tube 138 by means of screws 170 connected through a second straight bracket 168.

Mounted within the housing 162 and maintained stationary relative thereto is a gauge dial face 172 having spaced apart markings to provide a visual indication of the forces exerted by the user patient during use of the wrist/ankle exercise apparatus 100. Rotatably mounted above the dial face 172 is a dial pointer 174. The dial pointer 174 is secured to a gear shaft 176 by means of a screw 178 and stationary washer plate 180. The mounting of the dial pointer 174 above the dial face 172, and the mounting of gear shaft 176 through dial gauge housing 162 and dial face 172, allows the shaft 176 to rotate relative to the dial face 172, thereby correspondingly rotating dial pointer 174 to indicate magnitudes of externally exerted forces by the user patient as described herein.

Figure 4:
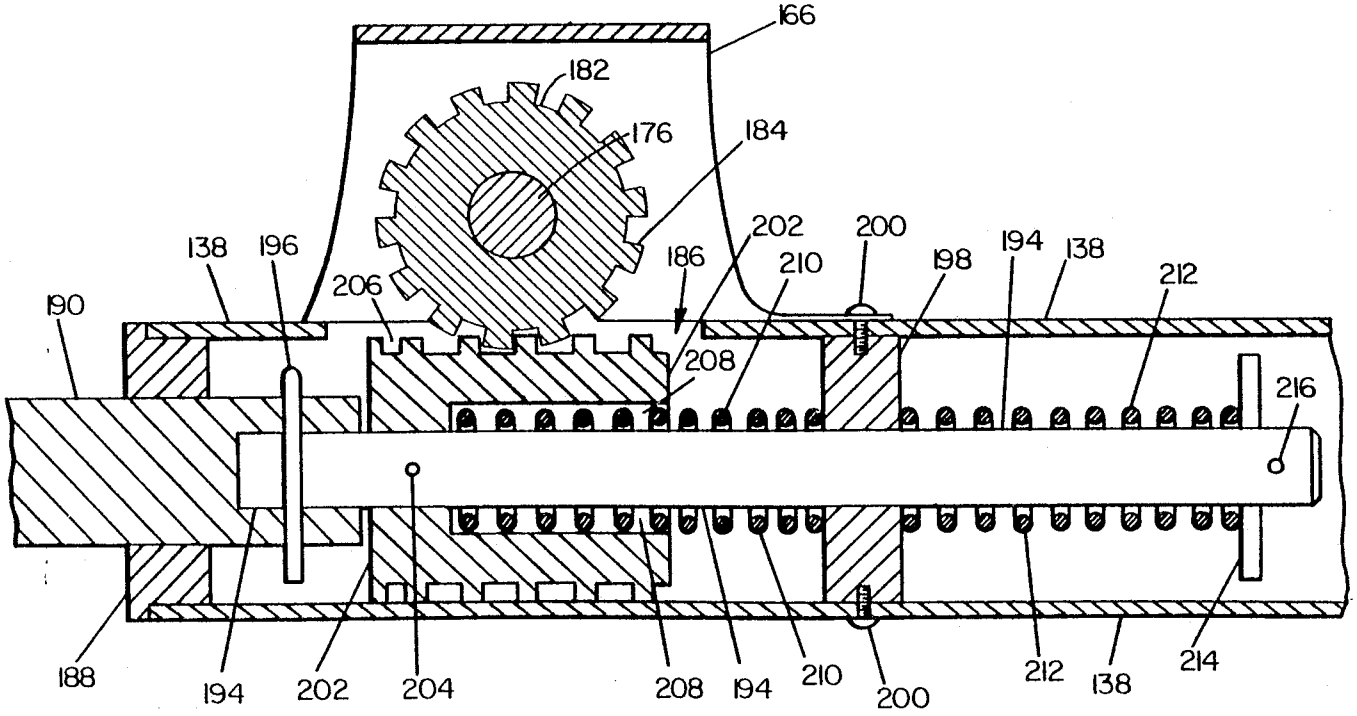
FIG. 4 is a sectional view of the force measuring mechanism taken along lines 4—4 of FIG. 3.

As also shown in FIG. 3, gear shaft 176 extends outwardly from the gauge housing 162 towards the rear of exercise apparatus 100. Rigidly mounted to gear shaft 176 at one end thereof is a pinion gear 182 having a series of gear teeth 184. Referring to FIG. 4, the pinion gear teeth 184 extend into a slot 186 located in the radial surface of elongated outer tube 138.

As also shown in FIG. 4, a stop and guide block 188 is mounted in the end of outer tube 138 adjacent the force measurement mechanism 140. Referring to FIGS. 1 and 2, a stationary rod 190 is rigidly secured to an end bracket 192 mounted to an outer one of the cross-members 106. The stationary rod 190 extends inwardly from the end bracket 192 into the elongated outer tube 138 through the guide block 188. As shown in FIG. 4, the end of stationary rod 190 extending into outer tube 138 includes a recessed area conforming to the shape of a slide rod 194. One end of the slide rod 194 is rigidly secured to the stationary rod 190 by means of a cotter pin 196 or other suitable connecting means. The slide rod 194 extends at least partially along the axial length of outer tube 138, is centrally positioned therein, and supported by means of a stationary guide block 198 rigidly secured to the outer tube 138 through screws 200.

Located within the outer tube 138, and intermediate the guide block 198 and the end of slide rod 194 received within stationary rod 190, is a spring cup 202 as depicted in FIG. 4. The spring cup 202 includes a cylindrical aperture in which the slide rod 194 is axially received. Slide rod 194 is secured in a stationary position relative to spring cup 202 by means of a pin 204 or similar connecting means.

The spring cup 202 can be substantially cylindrical in shape and includes peripheral rack teeth 206. The rack teeth 206 are positioned within outer tube 138 adjacent the slot 186, and the pinion gear teeth 184 are positioned so as to engage the rack teeth 206.

As also shown in FIG. 4, the spring cup 202 includes a centrally located slot 208 open at one end and extending partially through the axial length of the spring cup 202. Mounted within the slot 208 and extending outwardly around the slide rod 194 to the guide block 198 is a first compression spring 210. Bearing against the opposing surface of guide block 198 from the first compression spring 210 is a second compression spring 212. The second compression spring 212 is also positioned around the radial surface of slide rod 194 and supported at opposing ends by the guide block 198 and a washer 214 fixed in a stationary position relative to the slide rod 194 by means of a roll pin 216 or similar securing means.

In operation, as the power slide 142 exerts forces along the elongated tube 138, the tube 138 will move axially with respect to slide rod 194 in direct proportion to the frictional force between the sleeve 144 and the outer tube 138. Movement of the slide rod 194 will result in corresponding movement of the spring cup 202 relative to the tube 138. Movement of spring cup 202 relative to tube 138 will cause rotational movement of the pinion gear 182 through engagement of the pinion gear teeth 184 with the rack teeth 206. Rotation of pinion gear 182 will cause corresponding rotation of dial pointer 174 coupled through gear shaft 176 as previously described.

The resistance of the movement of the slide rod 194 with respect to the outer tube 138 is directly proportional to the frictional force of the power slide 142 on the outer tube 138. As the outer tube 138 moves to the left relative to the slide rod 194 as viewed in FIG. 4, the first compression spring 210 will be increasingly compressed, thereby requiring increasing forces to continue movement of the outer tube 138 relative to the spring cup 202 and slide rod 194. Similarly, as the outer tube 138 is moved to the right as viewed in FIG. 4 relative to the slide rod 194, the second compression spring 212 will be compressed, thereby requiring increasing forces to provide further movement. Thus, the movement of the dial pointer 174 is directly proportional to the frictional force between the sleeve 144 and the outer tube 138.

Referring to FIG. 2, the wrist/ankle exercise apparatus 100 also includes a pair of adjustable control rings 218 (only one being shown in FIG. 2) received on the elongated outer tube 138 on opposing sides of the power slide 142. Each control ring 218 is slidable along the outer tube 138 and has a set screw 219 threaded therein to secure the ring 130 in a selectively adjusted position. Intermediate each of the control rings 218 and the power slide 142 is a lubrication ring 220 (again, only one being shown in FIG. 2). Each of the lubrication rings 220 can be made of leather or similar material, and impregnated with a lubricant. The magnitude of resistance required to move the power slide 142 with respect to the outer tube 138 can be decreased by providing lubrication on the tube 138 by sliding the lubrication rings 220 along tube 138. Similarly, resistance can be increased by removing lubrication from the outer surface of tube 138, and variable resistance can be provided over a particular range of motion by selectively lubricating or removing lubrication from various portions of tube 138. The adjustable control rings 218 provide a means for limiting the range of motion of power slide 142 relative to tube 138. In addition, moving the control rings 218 inward so that the motion of power slide 142 is blocked will allow isometric exercise and isometric testing of muscle strength of the user.

Referring again to FIG. 2, and as previously referenced, the wrist/ankle exercise apparatus 100 includes a pair of cable support brackets 154 connected to the power slide 142 and mounted on the elongated tube 138. A cable 222 is connected at its ends to each of the cable support brackets 154 and wound around the pulley wheel 128 intermediate the brackets 154. The power slide sleeve 144 and associated cable support brackets 154 received on the outer tube 138 are slidable on the rear frame member 104 by means of a U-shaped slide member 224 rigidly secured to the power slide sleeve 144 and slidably mounted on the member 104.

Referring to both FIGS. 1 and 2, exercises employing the wrist/ankle exercise apparatus 100 are initiated by rotation of the handle assembly 120. Rotation of the handle assembly 120 correspondingly rotates pulley wheel 128 through rotation of axle 126. As the pulley wheel 128 is rotated, the interconnecting cable 222 mounted to the cable support brackets 154 causes corresponding movement of power slide 142. The frictional mounting between power slide 142 and the elongated outer tube 138 will result in axial movement of the power slide 142 along the tube 138 and, in addition, movement of the elongated tube 138 relative to the stationary rod 190. The movement of the elongated tube 138 relative to the stationary rod 190 will result in rotation of dial pointer 174 so as to indicate a quantative measurement of the forces applied by the user patient.

Although the handle assembly 120 is adapted for use by the user patient to perform particular exercises as subsequently described herein, other types of handle assemblies and similar structures can also be utilized with wrist/ankle exercising apparatus 100. For example, as depicted in FIG. 6A, the handle assembly 120 can be removed from the vertically disposed plate 118 and an offset handle assembly 226 can be substituted therefor. Like the handle assembly 120, the handle assembly 226 includes a handgrip 228 and bracket 230. However, in contrast to assembly 120, the handle assembly 226 includes an offset axle 232 which can be inserted through the vertical plate 118 and rigidly secured to the pulley wheel 128 so as to provide an offset between a central axis extending radially through the handgrip 228 and bracket 230 relative to an axis extending through the offset axle 232.

Other types of assembies can also be utilized with wrist/ankle exercise apparatus 100. For example, the handle assemblies 120 and 226 include handgrips 122 and 228, respectively, each of which lies in a plane perpendicular to the axis of interconnection to the pulley wheel 128. In contrast, the handle assembly 234 shown in FIG. 6B includes an axial handgrip 236 having a central axis extending parallel to the axis of interconnection with the pulley wheel 128. Specifically, the handle assembly 234 includes a bracket 238 offsetting the axial handgrip 236 from an interconnected axle 240 which can be rigidly secured in any conventional manner to the pulley wheel 128.

The previously described handle assemblies 120, 226 and 234 are specifically adapted to provide rehabilitative exercises of the muscle/skeletal groups associated with the wrist and forearm. However, the exercising apparatus 100 is also adapted to provide exercises associated with rehabilitative therapy of muscle/skeletal groups involving the lower leg and ankle regions. To provide such exercises, a foot pedal assembly 242 as shown in FIG. 6C can be utilized in place of the handle assembly 128 depicted in FIG. 1. The foot pedal assembly 242 includes a horizontally disposed base portion 244 having a rectangular configuration. A vertically disposed bracket 246 is attached to one side of the base portion 244 offset from the center area thereof. An axle 248 extends outwardly from the vertically disposed bracket 246 on the opposing side of the bracket surface attached to base portion 244, thereby providing a means for inserting the foot pedal assembly 242 through the vertically disposed plate 118 and rigidly securing pedal assembly 242 to the pulley wheel 128. In addition, to provide a means for rigidly securing the user patient's foot on the foot pedal assembly 242 as subsequently described herein, the assembly 242 includes a flexible strap 250 which can be attached to a buckle 252.

FIGS. 7–11 depict various exercises which can be performed by a patient 254 using the wrist/ankle exercising apparatus 100 and employing different ones of the handle assemblies and foot pedal shown in FIGS. 1 and 6A–6C. To provide an exercise associated with forearm rotation, the patient 254 maintains a sitting position with the wrist/ankle exercising apparatus 100 disposed in a horizontal plane adjacent the upper torso of the patient 254 as depicted in FIG. 7. With the patient 254 in the sitting position, the upper arm is maintained at the patient's side, and the forearm is extended forward and strapped within the saddle assembly 108, with the assembly 108 mounted in the front member 104. The patient's hand is utilized to grip the handgrip 122 of the handle assembly 120 depicted in FIG. 1.

From an initial position with the handgrip 122 in a vertically disposed plane, the patient 254 rotates his hand through an arc of 180° to provide full forearm rotation. Referring to FIGS. 1 and 2, rotation of the handle assembly 120 will correspondingly cause rotation of the pulley wheel 128. Through the cable 222, rotation of the pulley wheel 128 will exert forces on the cable support brackets 154, thereby resulting in movement of the power slide sleeve 144 relative to the elongated tube 138. As previously described, movement of the outer tube 138 relative to the stationary rod 190 will result in a visual indication of the forces exerted by the patient 254 through movement of the dial pointer 174 of force measuring mechanism 140.

One exemplary exercise utilizing the handle assembly 234 depicted in FIG. 6B provides for wrist flexion and extension as depicted in FIG. 8. As shown therein, the patient 254 maintains a sitting position at the side of rectangular frame 102 of the exercising apparatus 100. Utilizing handle assembly 234 in place of handle assembly 120, the patient 254 maintains his upper arm at his side and extends his forearm forward so as to be securely strapped within the saddle assembly 108. In this exercise, the saddle assembly 108 is moved from the front member 104 and releasably secured in the socket 116 of cross-member 106 depicted in FIG. 1. The patient's hand is utilized to grip the axial handgrip 236, with the fingers pointing in either an upward or downward direction as desired. To provide full wrist flexion and extension, the patient 254 preferably rotates his hand through an arc of approximately 70°.

Figure 9:
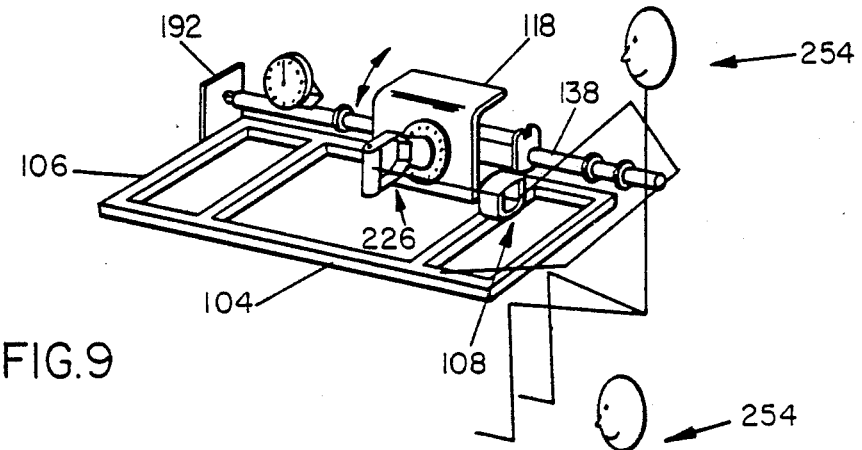
FIG. 9 depicts use of the wrist/ankle exercising apparatus shown in FIG. 1 for wrist flexion and extension, with employment of the alternative handle assembly depicted in FIG. 6A.

Another exercise to provide wrist flexion and extension is depicted in FIG. 9. Specifically, the patient 254 maintains the position previously described with respect to FIG. 8 relative to the positioning of exercising apparatus 100 and the saddle assembly 108. However, in contrast to the exercise depicted in FIG. 8, the patient 254 utilizes the handle assembly 226 depicted in FIG. 6A, with the handgrip 228 initially disposed in a vertical plane. Instead of hand rotation, the patient 254 generates a wrist flexion movement so as to provide appropriate exercise to the wrist muscle/skeletal group. Preferably, to provide full wrist flexion and extension, the wrist is flexed through a 90° arc.

Figure 10:
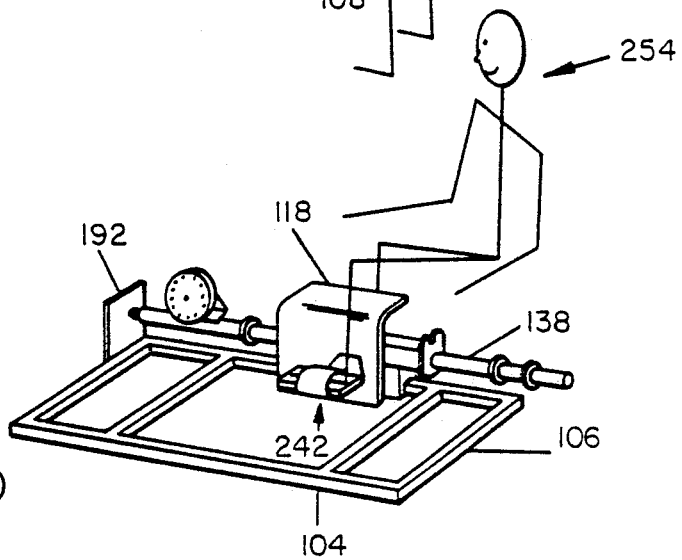
FIG. 10 depicts use of the wrist/ankle exercising apparatus shown in FIG. 1 for ankle flexion, with employment of the foot pedal assembly depicted in FIG. 6C.

As previously described, the wrist/ankle exercising apparatus 100 is also adapted to provide rehabilitative exercises for the muscle/skeletal groups surrounding the ankle region. For example, one exemplary exercise utilizing the foot pedal assembly 242 depicted in FIG. 6C provides for ankle flexion of the plantar muscle group as shown in FIG. 10. Specifically, the patient 254 can maintain a standing, sitting or prone position, with the foot pedal assembly 242 employed in place of the handle assembly 120. With this particular exercise, it is unnecessary to utilize the saddle assembly 108. The patient's foot is releasably secured on the foot pedal assembly 242, with the patient's toes pointing toward the end of the rectangular frame 102 opposing the bracket end adjacent the patient 254. The patient's foot is then rotated upwardly, thereby providing ankle flexion of the plantar muscle group. Preferably, to provide for full ankle flexion, the foot is rotated through an arc of 45°.

Figure 11:
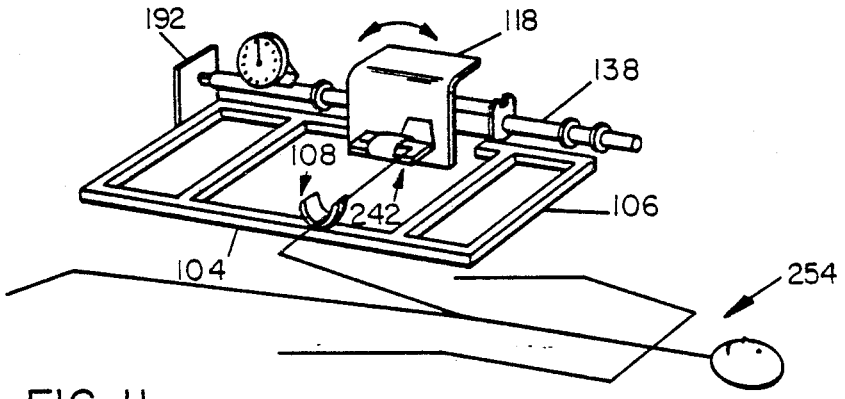
FIG. 11 depicts use of the wrist/ankle exercising apparatus shown in FIG. 1 for lower leg rotation, with employment of the foot pedal assembly depicted in FIG. 6C.

An exemplary exercise to provide lower leg rotation is shown in FIG. 11. The patient 254 maintains a prone position on his side with one of his lower legs extended and bent at the knee region. The leg is releasably secured in the saddle assembly 108, with the assembly 108 mounted to the rectangular frame 102 in the location depicted in FIG. 1. The patient's foot is strapped within the foot pedal assembly 242. The patient then rotates his foot through an arc of up to 70° to provide full lower leg rotation.

The wrist/ankle exercising apparatus 100 can be adapted to provide a variety of other types of exercises, depending on the particular rehabilitative needs of the patient. Furthermore, the principles of the invention are not limited to the specific portable wrist/ankle exercising apparatus 100 described herein. For example, the positioning of the force measuring mechanism 140 can be moved to various locations relative to the ends of the elongated tube 138. In addition, force measuring devices other than the specific mechanism 140 can be employed with the exercising apparatus 100. It will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. A wrist/ankle exercise apparatus comprising:

a portable structural frame providing a fixed base support while the exercise apparatus is in use;

a stationary elongated member connected to said frame;

an elongated tube axially movable with respect to said elongated member, wherein said elongated member is at least partially received within said tube;

a slide member slidably mounted on said elongated tube;

means for providing frictional resistance to movement of said slide member along said elongated tube by a user during exercise;

a slide-actuating member rotatably mounted to said frame and coupled to said slide member to translate rotational movement of said slide-actuating member to linear motion of said slide member on said elongated tube;

force measuring means mounted to said elongated tube for visually indicating to said user the relative magnitude of force applied between said slide member and said elongated tube;

whereby said user may move said slide member along said elongated tube by rotation of said slide-actuating member; and said force-measuring means comprises means for coupling said elongated member to said elongated tube so that the displacement of said tube relative to said stationary member is proportional to the relative magnitude of force applied between said slide member and said tube.

2. A wrist/ankle exercise apparatus in accordance with claim 1 and further comprising pedal means mounted to said slide-actuating member and operable by said user through rotation of an ankle of said user.

3. A wrist/ankle exercise apparatus in accordance with claim 1 and further comprising handle means releasably secured to said slide-actuating member so that said user can move said slide member along said elongated tube by axial rotation of his or her arm.

4. A wrist/ankle exercise apparatus in accordance with claim 1 and further comprising body-engaging means mounted to said structural frame and adapted to receive one of said user's arms or legs so as to restrain movement of said arm or leg during rotation of said slide-actuating member.

5. A wrist/ankle exercise apparatus in accordance with claim 4 wherein said body-engaging means comprises a U-shaped saddle mounted to said structural frame, and means mounted to said saddle for releasably retaining said leg or arm within said saddle.

6. A wrist/ankle exercise apparatus in accordance with claim 1 wherein said elongated tube comprises a first end mounted to said structural frame, and said force measuring means is positioned adjacent said first end of said elongated tube.

7. A wrist/ankle exercise apparatus in accordance with claim 1 and further comprising a goniometer mounted to said slide actuating member for indicating to the user the degree of rotation of said slide actuating member during rotation thereof.

8. A wrist/ankle exercise apparatus in accordance with claim 1 and further comprising means on said elongated tube for selectively limiting movement of said slide member along said elongated tube.

9. A wrist/ankle exercise apparatus in accordance with claim 8 wherein said movement limiting means comprises a pair of rings slidable on said elongated tube, one of said rings is positioned on each side of said slide member and means on each ring for securing said ring in adjusted position on said elongated tube, whereby said slide member can be limited to movement along the entire length of said tube down to no movement at selected positions along the length of said elongated tube for isometric strength testing and/or isometric exercise at any position within the range of movement of said slide member on said elongated tube.

10. A wrist/ankle exercise apparatus in accordance with claim 1 wherein said force measuring means has a dial face mounted to said elongated tube and visable to said user, and a pointer is rotatably mounted on said dial face to visually indicate the force applied to said slide member.

11. A wrist/ankle exercise apparatus in accordance with claim 1 and further comprising means received on said elongated tube for prohibiting movement of said slide member for isometric strength testing and/or isometric exercise of said slide member at any position within the range of movement of said slide member on said elongated tube.

12. A wrist/ankle exercise apparatus in accordance with claim 1 and further comprising offset handle means releasably mounted to said slide-actuating member, and having a handgrip positioned in a plane parallel to the plane of said elongated tube, with said handgrip being offset from an axis of rotation of said slide-actuating member so that said user can move said slide member along said elongated tube by rotation of said user's wrist.

13. A wrist/ankle exercise apparatus in accordance with claim 1 and further comprising offset handle means releasably mounted to said slide-actuating member, and having a handgrip positioned in a plane perpendicular to the plane of said elongated tube, with said handgrip being offset from an axis of rotation of said slide-actuating member so that said user cam move said slide member along said elongated tube by rotation of said user's wrist.

* * * * *